United States Patent [19]

Sieverding et al.

[11] Patent Number: 4,708,267

[45] Date of Patent: Nov. 24, 1987

[54] DISPENSER FOR PASTY COMPOSITIONS

[75] Inventors: Werner Sieverding; Herbert Mettenbrink; Günter Pohlmann; Ludger Hackmann, all of Lohne, Fed. Rep. of Germany

[73] Assignee: Bramlage Gesellschaft mit beschränkter Haftung, Lohne, Fed. Rep. of Germany

[21] Appl. No.: 726,580

[22] Filed: Apr. 24, 1985

[30] Foreign Application Priority Data

May 9, 1984 [DE] Fed. Rep. of Germany ..... 3416999

[51] Int. Cl.[4] ..... B65D 37/00

[52] U.S. Cl. ..... 222/211; 222/212; 222/214; 222/386; 401/141; 401/145; 401/148; 401/265

[58] Field of Search ..... 222/205, 206, 207, 214, 222/389, 211, 386, 212; 401/141, 145, 148, 190, 261, 264, 265, 266

[56] References Cited

U.S. PATENT DOCUMENTS

| | | | |
|---|---|---|---|
| 2,034,137 | 3/1936 | Fitz-Gibbon | 401/266 |
| 2,895,650 | 7/1959 | Mahon et al. | 222/389 X |
| 2,913,749 | 11/1959 | Ayres | 401/190 |
| 2,949,621 | 8/1960 | Clement et al. | 401/148 |
| 2,961,679 | 11/1960 | Claypool | 401/266 |
| 3,841,532 | 10/1974 | Gores | 401/190 X |
| 3,870,200 | 3/1975 | Spatz | 222/206 |

FOREIGN PATENT DOCUMENTS

| | | | |
|---|---|---|---|
| 1210149 | 2/1966 | Fed. Rep. of Germany . | |
| 3042285 | 6/1982 | Fed. Rep. of Germany . | |
| 1360234 | 3/1964 | France | 401/265 |
| 1535749 | 7/1968 | France | 222/206 |

*Primary Examiner*—Joseph J. Rolla
*Assistant Examiner*—Frederick R. Handren
*Attorney, Agent, or Firm*—Martin A. Farber

[57] ABSTRACT

A dispenser for pasty compositions (M) having a housing (1) in which there is arranged a piston (2) which is displaceable only in the emptying direction. An outer actuating handle is provided on a wall (10) of the head piece (K). The wall can be pressed in the direction towards the piston, the head piece having a dispenser outlet opening (7) which lies at the outer end (9'') of a tube (9) whose end section (9') forms an inner open mouth end the end section over its entire length protruding inwards beyond the wall into the pasty composition. In order to obtain a structural shape which is simple to manufacture and a self-regulation of the delivery which is free of loss the actuating handle is formed as a dome-shaped cap (6) and is seated on a collar (12) which lies concentric to the tube (9) and which collar protrudes outwardly beyond the wall (10). A removable closure lid has a stopper which extends into the dispenser outlet opening. The closure lid is spaced from the cap and is held against an annular wall which extends on the outside of the housing spaced apart from an edge of the cap.

9 Claims, 4 Drawing Figures

DISPENSER FOR PASTY COMPOSITIONS

FIELD AND BACKGROUND OF THE INVENTION

The present invention relates to a dispenser for pasty compositions, having a housing in which there is arranged a piston which is displaceable only in the emptying direction, an actuating handle which is located on the outside and is on a wall of the head piece, which wall can be pressed inwards in the direction towards the piston, the head piece having a dispenser outlet opening which is at the outer end of a tube, the tube having an end section which has an inner open mouth end and which extends its entire length inwardly beyond the wall into the pasty composition.

A dispenser of this type is known from Federal Republic of Germany OS No. 30 42 285. The actuating handle which is formed in that case as a bellows, upon its release pulls the piston along with it up the column of filling material. This pulling of the piston occurs first, i.e. before the residual quantity in the tubule, which quantity acts as a plug, could be sucked inwardly out of the tubule and air could compensate for the resultant vacuum. The pasty composition thus itself forms the valve. A conventional valve, such as used for instance in Federal Republic of Germany AS No. 12 10 149, can be dispensed with and the structural shape is thereby considerably simplified.

From European Patent Publication No. 0 100 204 there is known a dispenser having a dome-shaped applicator wall with a centrally located outlet opening. The pasty composition is dispensed via a manually actuatable screw piston. A mechanism of the type known from lipstick cases is used. It is relatively expensive. Furthermore, an inaccurate dose and particularly an overdose readily results.

SUMMARY OF THE INVENTION

The object of the present invention is to develop a dispenser of the introductory-mentioned type in a manner which is simple to manufacture and advantageous in use in such a way that the delivery is self-regulated without loss upon use of the dispenser.

According to the invention the actuating handle is developed as a dome-shaped cap (6) and is seated on a collar (12) which projects outwardly beyond the wall (10) and is concentric to the tube (9).

By the invention, a dispenser is obtained which is of increased value in use. The actuating handle itself forms the applicator surface which spreads the pasty content, for instance an ointment. The actuating handle is formed as a dome-shaped cap. The cap is coordinated to the membrane-acting wall to whose protruding tube it is connected in a simple manner via a collar. The cap and collar are advantageously formed of a single piece. It is furthermore proposed that the tube be seated concentrically in the dome-shaped wall and be surrounded by an annular elastic zone. The concentric position of the tube leads to a high degree of mobility of the wall. Furthermore, the restorability is enhanced. The fact that the wall is mounted on a stopper connected to the housing is favorable from an assembly standpoint. The stopper, wall and tube form a single manufacturing piece. Furthermore, material which is optimal for the restoring function and as a seal can be used. Also to optimize the spatial conditions for the tiltability of the dome-shaped cap, a sufficient distance is left between the inner surface of the cap and the wall. In accordance with the invention, the cap is covered by a closure lid. The latter extends at a distance from the cap in such a manner that the inner surface of the closure lid does not come into contact with the applicator surface. The inner surface thus does not become smeared. Furthermore, the closure lid is used at the same time to seal off the outlet opening of the dispenser, said lid having a stopper which enters said opening. The closure lid is held on an annular wall of the housing which extends on the outside of and spaced from the edge of the cap defining an annular space. The edge of the cap extends here into this annular space.

BRIEF DESCRIPTION OF THE DRAWINGS

The object of the invention is explained in further detail below with reference to two embodiments, shown in the drawing, in which.

DETAILED DESCRIPTION OF THE PREFERRED EMBODIMENTS

Figure 1:
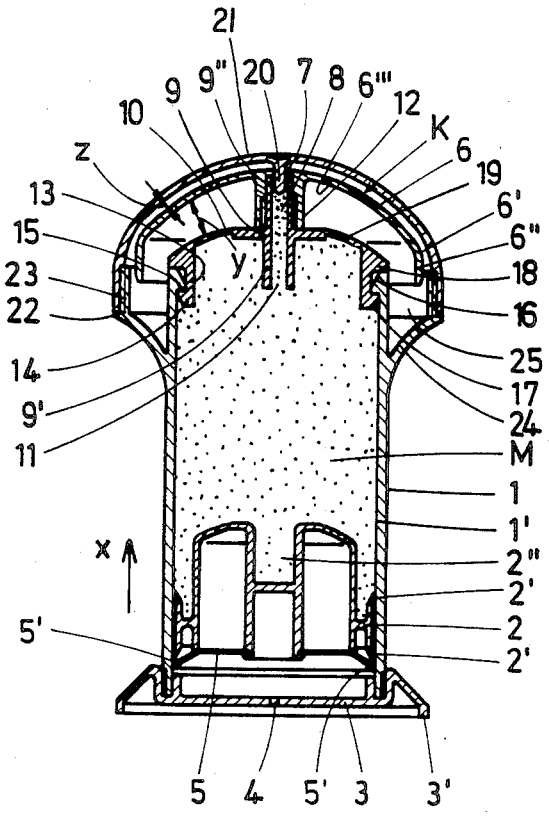
FIG. 1 is a vertical axial section through the dispenser according to the first embodiment.
Figure 2:
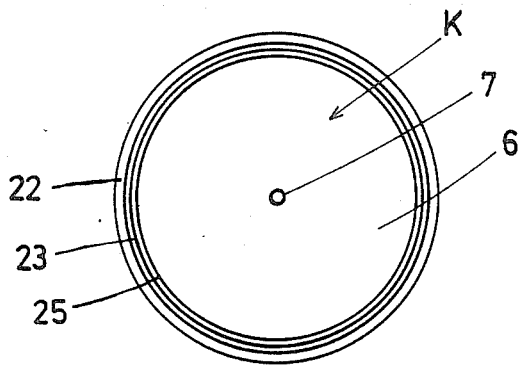
FIG. 2 is a top view of this dispenser with the closure lid removed.

The cylindrical housing 1 of the dispenser contains a piston 2. The oppositely directed edge lips 2' of the piston are guided on the inner wall 1' of the cylindrical housing. The housing 1 is closed on the bottom by the bottom part 3 which forms a standing base 3'. It has a central opening 4 for equalization of the dispensed contents M from the housing 1 by air replacement upon displacement of the piston.

The piston can be displaced only in the direction of emptying of the contents M of the dispenser (arrow x). On its broad surface facing the standing-base end of the housing the piston bears a so-called clamping module 5 in the form of a spider made of spring steel having radially directed prongs 5'. Its diameter when unstressed is greater than the inside diameter of the housing 1, as a result of which the prong ends 5', as oblique supporting feet, engage against the inner wall 1' of the housing in such a manner as to oppose motion in the direction opposite the direction of the arrow x.

On the end opposite the standing base 3', the housing 1 has an actuating handle in the form of a cup-shaped cap 6 which dispenses the pasty composition. The cap is of dome shape. Its approximately spherical portion passes via a curvature 6' near the edge into a downwardly directed cap peripherical rim 6'' of the cap 6.

The cap 6 is provided centrally with an outlet opening 7 for the pasty composition M contained within the housing 1. A conduit 8 communicates with the opening 7 at the upper front edge of the conduit 8 which front edge also forms a dispenser outlet opening. The conduit 8 is formed as a small tube 9. The tube 9 is so shaped on a wall 10 which forms part of the headpiece K of the dispenser that its inner end section 9' extends into the pasty composition M over its entire length which protrudes inwardly beyond the wall. The completely free inner, continuously open mouth end 11 of the tube 9 is therefore surrounded, by the composition M, while its outer portion 9'', which thus protrudes outward and/or upwards beyond the wall 10, is attached to the cap 6. For this purpose the cap 6 is provided with a collar 12. Such a collar can be formed directly on the cap. The outer portion 9'' of the tube extends inside the collar. This may be a fixed or rigid plug-in type connection. In the embodiment shown, a threaded connection is preferred, for which purpose the portion 9'' of the tube 9 bears the corresponding outer thread and the cylindrical inner wall of the collar 12 bears the corresponding inner thread. The upper front edge of the tube is covered by the cap so that the conduit 8 and the outlet opening 7 have the same inside diameter. The cross section of the conduit corresponds to a fraction of the cross section of the inside of the container. The conduit 8 is of a length which corresponds approximately to 5 to 8 times the diameter of the conduit.

The wall 10 continues on the side of the housing so as to form a hollow stopper 13. The lower outer edge region of the stopper forms a clip ring 14 which engages behind a horizontal annular shoulder 15 of the housing 1. A run-on bevel 16 is provided in the front of the shoulder. The back of the clip ring also bears an undercut 17. The depth of insertion of the stopper 13 in the housing 1 is defined by an annular collar 18 which is formed on it and which engages against the upper end surface of the housing 1. Extending from this annular collar 18 which is thickened like a bead, the wall 10 extends in dome shape over the inside of the housing 1. The wall thus assumes a contour similar to the cap 6 which extends over it at a distance y away from it. While the central region of the wall 10 which surrounds the tube 9 is relatively thick and extends horizontally, the region adjoining this annular section passes into an elastic annular zone 19. The increased elasticity or flexibility is a result of a definite reduction in the wall thickness by about 50% as compared with the actual thickness of the wall. In this way there is produced a membrane of high mobility and tiltability. This tilting movement is effected by the cap 6, which serves as the cap 6, which serves as an instrument for spreading the dispensed contents. The distance y between the inner surface 6''' of the cap and the top of the wall 10 is adapted for even extreme displacements.

When not in use, the dispenser outlet opening 7 is closed by a stopper 20 of a closure lid 21, the stopper extending into the opening 7 and into the outer portion 9'' of the tube 9. A threaded connection can be provided. A simple force fit arrangement also may be sufficient. The closure position is precisely defined by a downwardly extended edge of the closure lid having its end surface come against an annular shoulder 22 of an annular wall 23 formed on the housing. The coordination is such that the inner surface of the closure lid extends over the outer surface of the cap, spaced from it by a distance z. Thus any residue of the pasty composition which may be still present on the dome-shaped applicator surface of the cap is not transferred to the closure lid. The stopper 20 entering the outlet opening additionally secures the position of the cap. Even a sudden blow, as for instance occurring when the dispenser is dropped, will not lead to a tilting of the cap 6.

Figure 3:
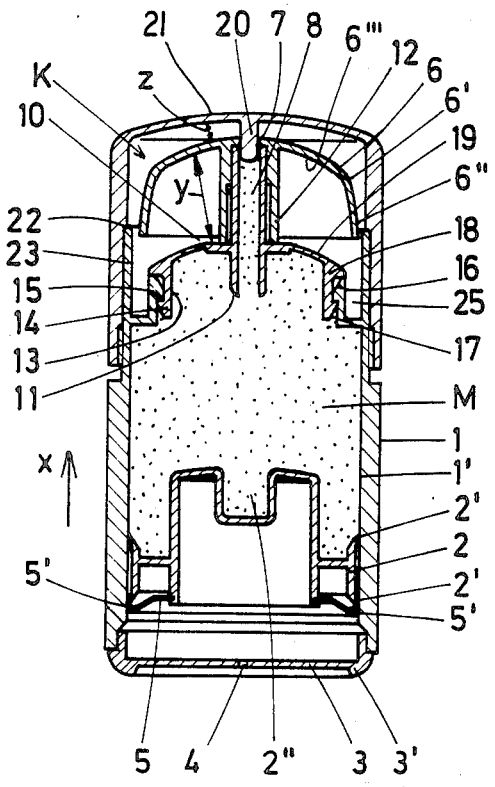
FIG. 3 shows the dispenser of the second embodiment, also in vertical axial section
Figure 4:
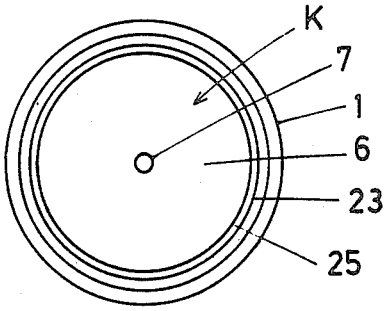
FIG. 4 is a top view thereof, again with the closure lid removed.

In the first embodiment, the annular wall 23 protrudes radially outwardly beyond the cylindrical wall of the housing. In this case the dispenser head K is of substantially mushroom shape. In the second embodiment (FIGS. 3 and 4) the dispenser is more like a bar. In FIG. 1 the annular wall 23 extends from a peripheral protrusion 24, the protrusion 24 having a concave ring-shaped course so that between the upwardly further extending housing wall and the circumferential annular wall 23 which is parallel thereto there is a circumferential annular space 25 into which the lower edge zone of the cap 6 easily extends. In the case of the second embodiment of FIGS. 3 and 4, an annular space 25 is formed within the cylindrical cross section of the housing 1. Insofar as necessary for understanding, the same reference numbers have been used in both embodiments.

In both embodiments the piston 2 has a projection which points in the direction of dispensing and fits exactly into the hollow space of the stopper 13, as a result of which the pasty composition is dispensed essentially without residue. To be sure, the hollow region 2'' of the piston which is intended for the inner end portion 9' of the tube 9 has a larger inside diameter than said end portion 9' so that the desired tilting movement of the membrane 19 is not prevented in the final phase of the dispensing.

The manner of operation of the dispenser described is as follows: After removal of the closure lid 21, the cap of the dispenser is directed towards the surface of that part of a person's body which is to be treated and placed on it. The exertion of a slight pressure on the cap 6 pushes in the convexly curved wall 10. The piston 2 rests on the clamp module 5 so that it cannot move downwardly. The pasty composition M therefore forces its way through the inner mouth end 11 into the conduit 8 in the direction towards the outlet opening 7 and out of the latter. As soon as the head piece K, i.e. the membrane, is again freed from external pressure, a vacuum is produced within the housing. The flexible wall 10 moves back into its basic normal position (shown in FIGS. 1 and 3) and pulls the piston 2 with it in the direction indicated by the arrow x up the column of filling material. The corresponding return movement of the flexible wall 10 is completed before the composition which still remains in the tube 9 as a plug could reach the inner mouth end 11. The decisive factor in this connection is that the tube 9 in cross section and length thereof, adapted to the viscosity of the pasty composition and the speed of the emerging flow, forms a corresponding resistance which overcomes the resultant vacuum. Furthermore, in all cases only that amount of pasty composition is dispensed as is required also for spreading. The slight inward pull of the plug-forming composition on the mouth side upon the termination of the treatment prevents overflow, so that the stopper 20 need not displace any material which would be thereby squeezed out. Rather, the stopper 20 penetrates in the tube 9 a region approximately to a depth of penetration which is free of pasty composition.

What is claimed is:

1. In a dispenser for pasty composition having a housing forming an opening and containing the pasty composition, a piston disposed in said housing displaceable only in an emptying direction toward the opening, a head piece extending over the opening of the housing and operatively connected to said housing, the head piece comprising a movable wall, an outer actuating handle operatively connected to the wall of said head piece, the wall being pressable inwardly in a direction towards the piston by pressing on said outer actuating handle, a tube having a dispenser outlet opening at an outer end of the tube, the tube being connected to the wall of the head piece for movement therewith and having an end section which forms an inner open mouth end through which the pasty composition enters, said end section with its entire length projecting inwardly beyond the wall extending into the pasty composition, the improvement comprising a collar which projects outwardly beyond the wall, is concentric to the tube and is operatively coupled to the tube for movement therewith, the actuating handle is formed as a dome-shaped cap constituting an applicator head for the pasty composition, is operatively coupled to the collar for movement therewith and thereby connected to said tube via said collar, said housing is formed with an annular wall which extends outside of and is spaced from an edge of the cap, and a closure lid having a stopper, said stopper extends into the dispenser outlet opening, said closure lid is spaced from the cap and is removably held against said annular wall of the housing.

2. The dispenser according to claim 1, wherein said collar is in one-piece with said cap.

3. The dispenser according to claim 1, wherein said wall is dome-shaped and includes an annular elastic zone surrounding a central region of said wall, said central region being relatively thick and substantially planar, said collar has an inner end abutting said central region of said wall, and the tube is disposed axially with respect to said housing and concentrically in the dome-shaped wall adjacent said central region and is surrounded by said central region and said elastic zone.

4. The dispenser according to claim 3, further comprising another stopper connected to the housing at a peripheral edge of said wall, and the wall is connected to another said stopper.

5. The dispenser according to claim 3, wherein said cap has a peripheral rim defining said edge of the cap, said peripheral rim is disposed radially beyond a peripheral edge of said wall, said cap has an inner surface spaced from said wall so as to permit tiltability of said cap.

6. The dispenser according to claim 1, wherein said annular wall of the housing and an upper portion of said housing form an annular space therebetween, said edge of the cap extends into said annular space.

7. The dispenser according to claim 4, wherein said wall, said another stopper and said tube are in one-piece.

8. The dispenser according to claim 4, wherein said piston has a projection which fits exactly into said another stopper and defines a hollow region into which said tube projects with play when said piston reaches said another stopper.

9. The dispenser according to claim 1, wherein said tube is secured to said collar at the outer ends of said tube and said collar and said tube and said collar are annularly spaced from each other from said outer ends to said wall.

* * * * *